US008257190B2

(12) United States Patent
Newman

(10) Patent No.: US 8,257,190 B2
(45) Date of Patent: Sep. 4, 2012

(54) GOLF STRAP

(76) Inventor: Michael Joseph Newman, Sherman Oaks, CA (US)

( * ) Notice: Subject to any disclaimer, the term of this patent is extended or adjusted under 35 U.S.C. 154(b) by 0 days.

(21) Appl. No.: 13/134,312

(22) Filed: Jun. 2, 2011

(65) Prior Publication Data

US 2011/0319183 A1 Dec. 29, 2011

Related U.S. Application Data

(60) Provisional application No. 61/398,230, filed on Jun. 23, 2010.

(51) Int. Cl.
*A63B 69/36* (2006.01)
*A41D 19/00* (2006.01)

(52) U.S. Cl. ..... 473/205; 473/212; 2/161.3

(58) Field of Classification Search ..... 473/201, 473/205, 206, 207, 212, 213, 226, 409; 2/159, 2/161.1, 161.2, 161.3
See application file for complete search history.

(56) References Cited

U.S. PATENT DOCUMENTS 2,077,202 A * 4/1937 Barrie ..... 119/14.22
2,258,999 A 10/1941 Nunn
2,270,882 A 1/1942 Link
2,302,875 A 11/1942 Lykins
2,456,678 A 12/1948 Cole
2,710,970 A 6/1955 Kennedy
2,738,190 A * 3/1956 Tureaud ..... 473/59
2,877,465 A 3/1959 Stroud
3,065,472 A 11/1962 Linnell
3,413,000 A * 11/1968 Alkonis ..... 473/61
3,496,573 A * 2/1970 Pope et al. ..... 2/161.6
3,648,292 A 3/1972 Strickler
3,848,874 A 11/1974 Elkins, Jr.
3,863,271 A 2/1975 Moroney
4,000,903 A 1/1977 Swanson
4,329,741 A 5/1982 Bach
4,665,565 A 5/1987 Odom
4,962,547 A 10/1990 Minnick
5,005,824 A * 4/1991 Eichel ..... 482/44
5,236,190 A * 8/1993 Moss ..... 473/450
5,253,367 A 10/1993 Lappley
D363,146 S * 10/1995 Pando ..... D29/113
5,634,214 A 6/1997 St. Ville
5,833,233 A * 11/1998 Strug ..... 473/450
(Continued)

FOREIGN PATENT DOCUMENTS

GB 2 232 338 12/1990

*Primary Examiner* — Nini Legesse
(74) *Attorney, Agent, or Firm* — Klarquist Sparkman, LLP

(57) ABSTRACT

According to this invention, a golf strap comprised of a flexible soft material with a visual alignment indicator and fastener is provided with a raised flexible bar across the palm portion, which aligns the golf club for proper gripping. The golf strap is worn around a golfer's hand, and the visual alignment indicator directs the golfer in proper golf strap placement before affixing the fastener to secure the golf strap. The flexible bar is so positioned across the palm portion of the golf strap that, when the golf club grip is held, the gripping hand of a golfer wearing the golf strap receives the grip portion of the club shaft across the palm of the golf strap and against the flexible bar. The flexible bar positions the club shaft to lie diagonally across the roots of the fingers. When the hand is closed around the golf club, with the flexible bar cradling the grip portion of the golf club, an automatic proper gripping of the golf club will be ensured.

6 Claims, 6 Drawing Sheets

U.S. PATENT DOCUMENTS 5,983,397 A 11/1999 Seminara
6,088,834 A 7/2000 Seminara
7,058,984 B2 6/2006 Newman
2002/0129437 A1 9/2002 Erker

* cited by examiner

GOLF STRAP

I am claiming the benefit of the filing date of provisional application No. 61/398,230 filed on Jun. 23, 2010.

BACKGROUND OF THE INVENTION

This invention relates to a golf strap worn around a golfer's hand to ensure proper gripping on a golf club. More particularly, the invention relates to a golf strap having an elongated raised flexible bar positioned across the palm portion of the strap and an adjustable fastener disposed on the end portion of the strap, providing adjustable sizing to fit most golfer's hand size. A visual alignment indicator ensures placement of the strap in-line with the golfer's index finger enabling correct positioning of the strap around the golfer's hand. The flexible bar positions the gripping end of a golf club to nest adjacent to the knuckles of the left hand, of a right-handed golfer, in a proper grip, aligning the gripping end of the golf club within the golfer's hand.

SUMMARY OF THE INVENTION

According to the invention a flexible strap is provided with an elongated raised flexible bar positioned across the palm portion, a visual alignment indicator, and a fastener enabling a player to attach and remove the strap around his hand. The visual alignment indicator is spaced appropriately from the flexible bar, so when the golfer places the strap across his palm the visual alignment indicator will be in-line with the index finger. The fastener is then secured firmly across the back of the hand enabling the player a proper fit regardless of hand size. Then, when the hand is closed around the shaft of the golf club with the flexible bar cradling the grip portion of the golf club, an automatic proper gripping of the golf club will be ensured. The flexible bar is substantially parallel to the distal transverse crease of the hand, lying diagonally across the roots of the fingers. The flexible bar spans substantially the entire palm of the hand.

The raised flexible bar is preferably formed of a soft semi cylindrical material affixed to the palm portion of the strap. The flexible bar is spaced away from the bases of the fingers by a distance that causes the flexible bar to partly wrap around the golf club and urge the grip toward the knuckles and away from the heel of the hand when gripping pressure is applied to the club.

The visual alignment indicator is preferably formed of paint or printed ink on the top portion of the strap, appropriately spaced away from the flexible bar so as to function as a guide to the golfer so the visual alignment indicator will be in-line with the index finger to ensure proper strap placement around the hand with the flexible bar positioned diagonally across the palm of hand.

The fastener is preferably formed of hook and loop material and spaced away from the visual alignment indicator and flexible bar to affix into a properly secure position across the back of the golfer's hand and ensure proper sizing.

It is then the object of this invention to provide a golf strap with flexible bar to ensure proper gripping of the golf club grip.

It is then the object of this invention to provide a golf strap with a visual alignment indicator to ensure strap placement across the golfer's hand.

Other and further objects of this invention will be apparent to those skilled in the art from the following detailed description and the accompanying drawings which show a preferred embodiment of the invention.

DETAILED DESCRIPTION OF THE INVENTION

The drawings are directed to a golf strap for a right-handed golfer.

Figure 1:
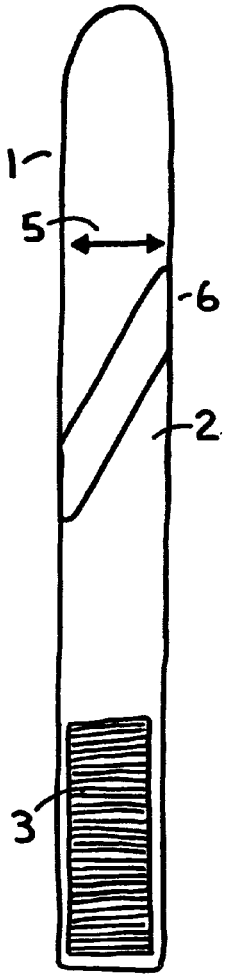
FIG. 1 is a front view of the golf strap in accordance with the invention.
Figure 2:
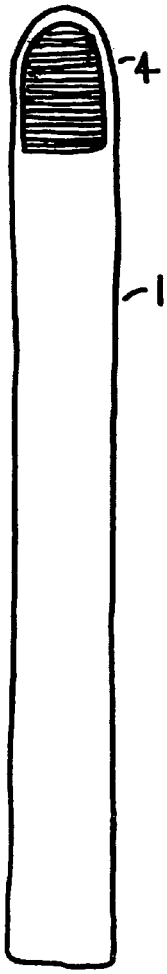
FIG. 2 is a bottom view of the golf strap in accordance with the invention.
Figure 6:
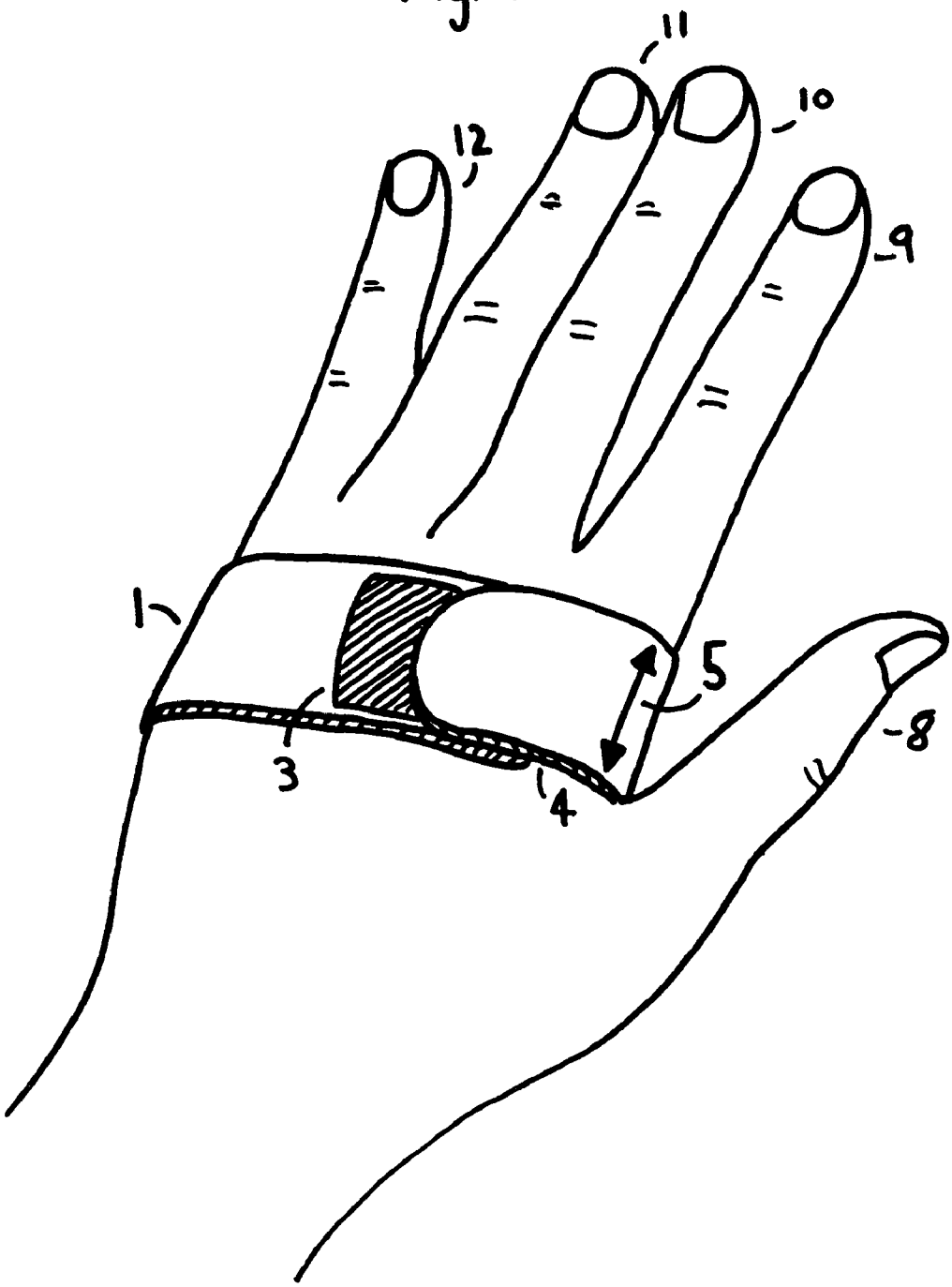
FIG. 6 is a perspective view of a golfer's left back of hand (right-handed golfer) wearing the strap of the invention.

The golf strap 1 shown in FIG. 1 is a front view of the strap with palm portion area 2, visual alignment indicator 5, loop fastener 3, and raised flexible bar 6. The golf strap 1 shown in FIG. 2 is a bottom view of the strap 1 with hook fastener 4. It will be understood that this golf strap 1 is conventional and illustrative of how it can be affixed around a golfer's hand. The golf strap 1 can be made out of any suitable material, such as soft rubber or fabric. The golf strap 1 may be replaced with other designs, and may be secured about the back of hand preferably using loop fastener 3 and hook fastener 4, but may be secured using snap fasteners, laces or other means for securing the strap, since the strap of this invention is adaptable to all such types of fasteners. The loop fastener 3 and hook fastener 4 will affix into a properly secure position across the back of the golfer's hand and ensure proper sizing as shown in FIG. 6.

Figure 3:
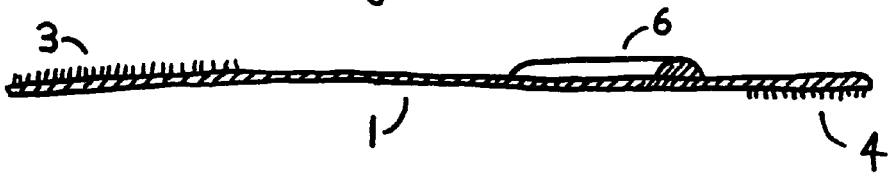
FIG. 3 is a side view of the golf strap in accordance with the invention.

The golf strap 1 shown in FIG. 3 is a side perspective of the raised flexible bar 6, loop fastener 3 and hook fastener 4.

Figure 4:
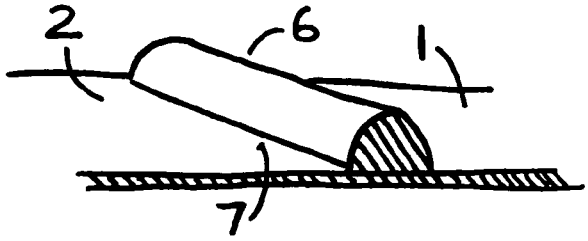
FIG. 4 is a transverse sectional view of the raised flexible bar in accordance with the invention.

As shown in FIG. 4, used here for illustration, the raised flexible bar 6 forms a semi cylindrical shape comprised of a soft material such as rubber or similar relatively stiff but bendable and somewhat resilient material. The raised flexible bar 6 of FIG. 4 preferably provides longitudinal stiffness and radial resilience thereby preventing the raised flexible bar 6 from creasing, folding over, or collapsing. At the same time, however, the raised flexible bar 6 is sufficiently deformable as to follow the contours of the golfer's hand and gripping portion of the golf club 14. The raised flexible bar 6 is preferably secured by adhesive 7, along the palm area 2, but may be permanently affixed by way of being molded to the strap, or temporarily secured using hook and loop, or similar fasteners.

Figure 5:
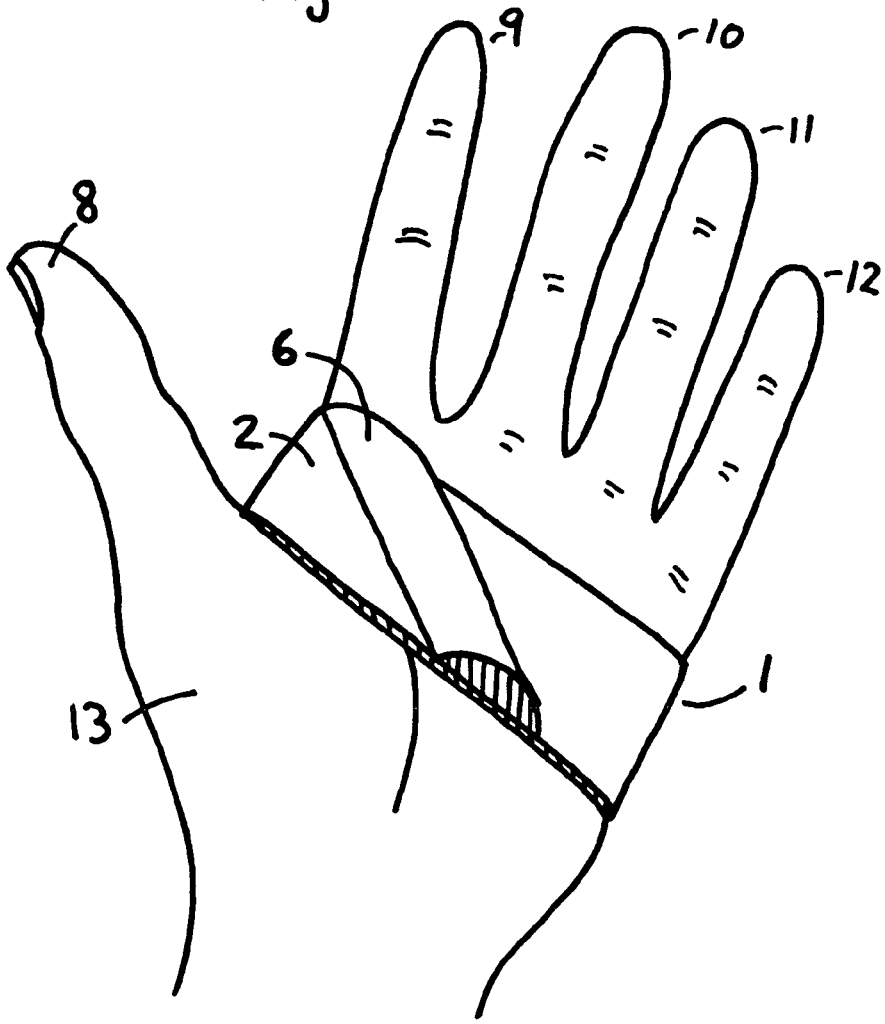
FIG. 5 is a perspective view of a golfer's left hand palm (right-handed golfer) wearing the strap of the invention.
Figure 11:
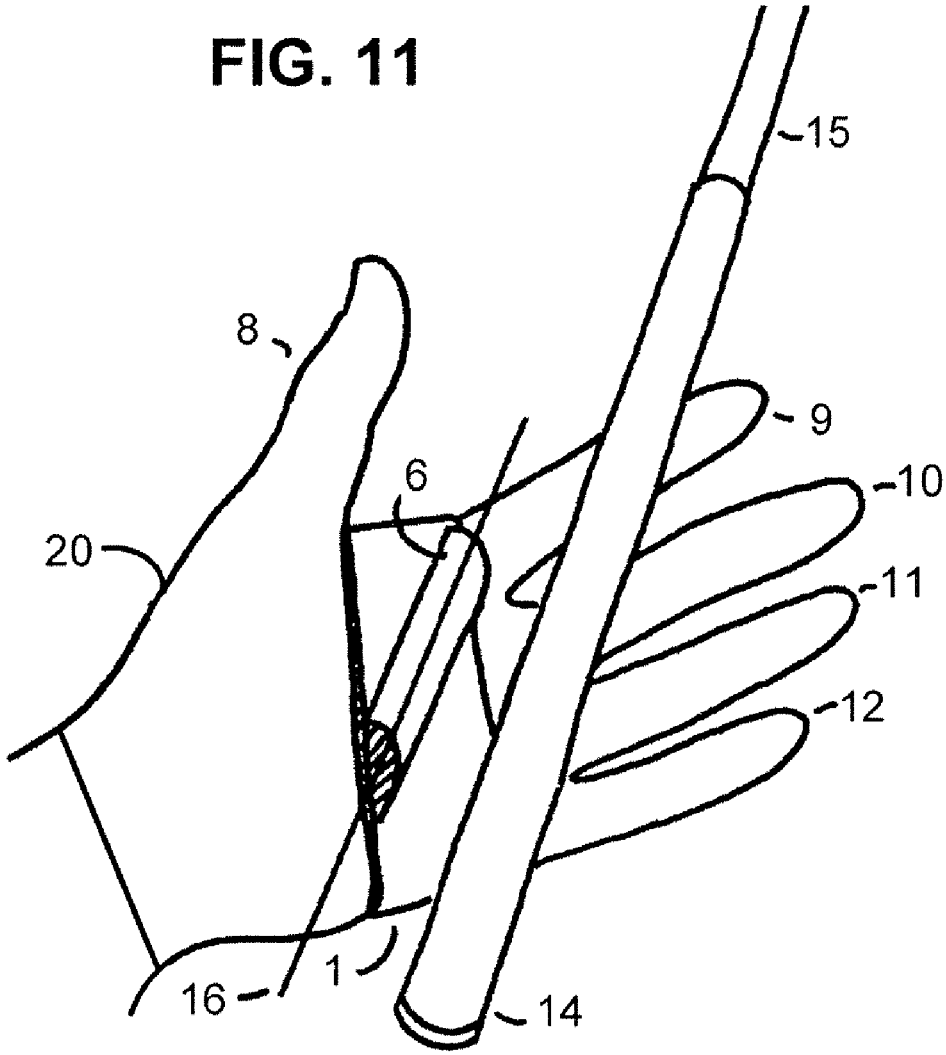
FIG. 11 is a perspective view of a golfer's left hand (right-handed golfer) wearing a golf strap over a glove.

In FIG. 5 the golf strap 1 of the current invention is affixed around a golfer's hand. The golf strap 1 includes a raised flexible bar 6 positioned on the palm portion 2. As shown in FIG. 11, the act of positioning the golf strap 1 can comprise positioning the golf strap 1 on an outside surface of a glove 20 worn on the user's hand so that the elongated strap at least partially surrounds the glove 20.

Figure 9:
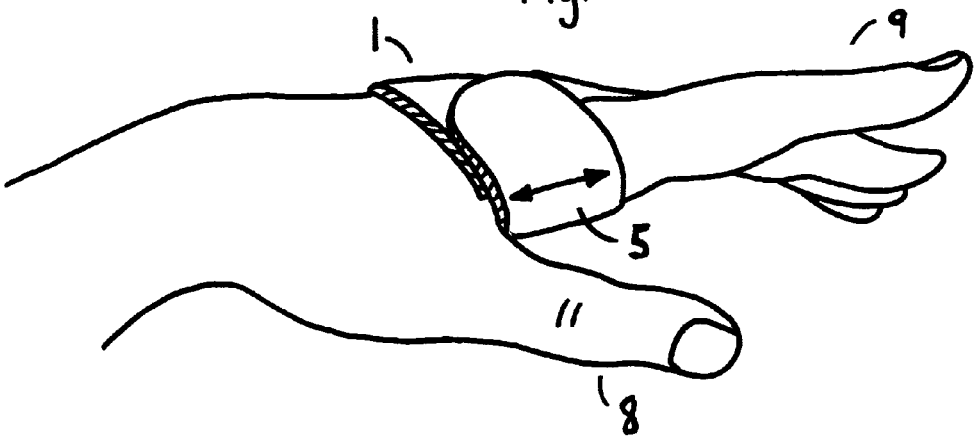
FIG. 9 is a perspective view of a golfer's left hand (right-handed golfer) wearing the strap of this invention to show the visual alignment indicator properly aligned to be in-line with the index finger.

In FIG. 9 the golf strap 1 of the current invention is affixed around a golfer's hand and presented from side view to show the visual alignment indicator 5, which is spaced respectively from the raised flexible bar 6, to identify proper golf strap 1 placement in relation to golfer's hand. Before affixing the hook 4 and loop 3 fasteners, the golfer will position the visual alignment indicator 5 to be in-line with his index finger 9. The visual alignment indicator 5 ensures proper placement of strap.

Figure 7:
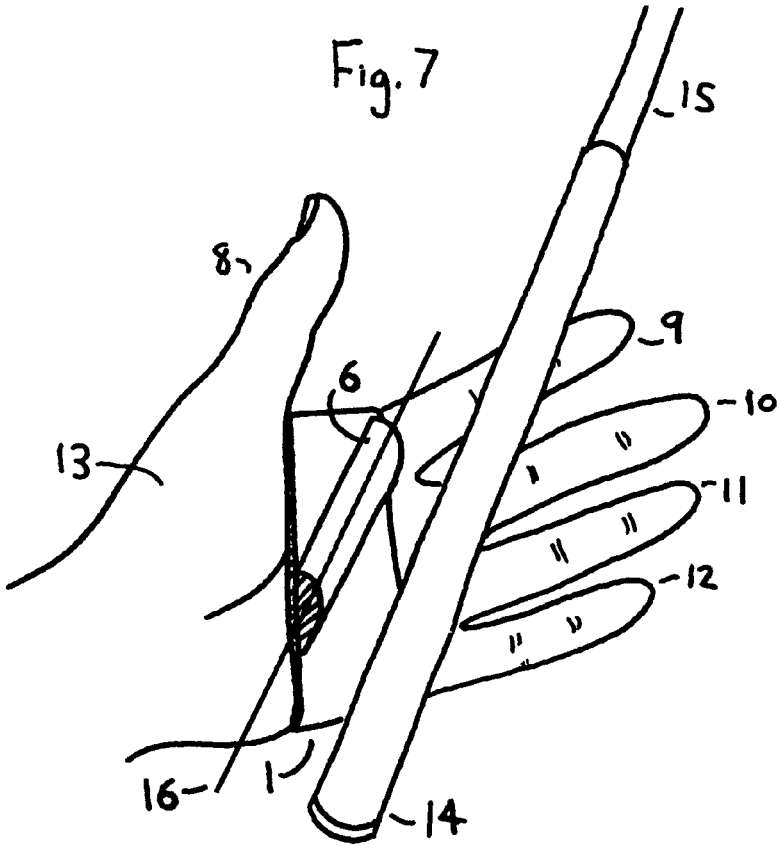
FIG. 7 is a perspective view of a golfer's left hand (right-handed golfer) wearing the strap of this invention with the gripping portion of the golf club resting in the golfer's fingers.
Figure 8:
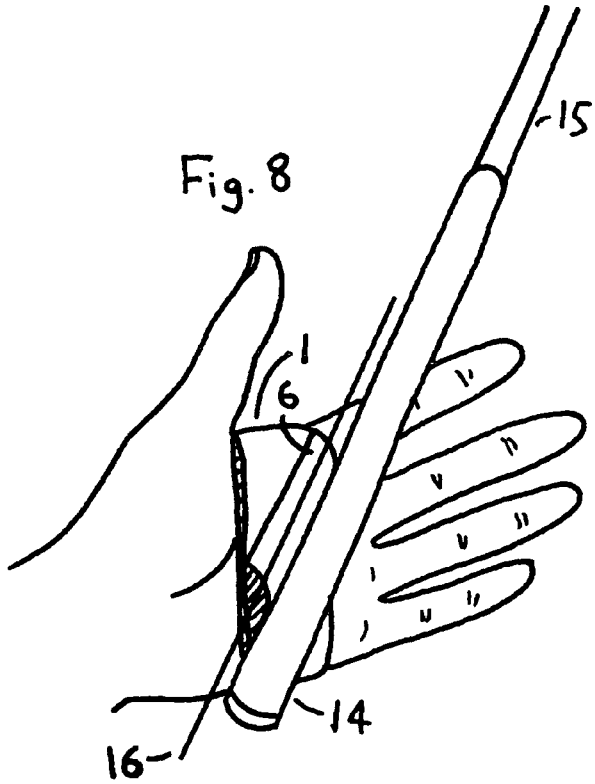
FIG. 8 is a perspective view similar to FIG. 7 but with the gripping portion of the golf club positioned against the flexible bar.

As shown in FIGS. 6-8 the golf strap 1 of the current invention includes a raised flexible bar 6 positioned on the palm portion 2 of the golf strap 1 such that when the golf strap 1 is affixed around the golfer's hand, the raised flexible bar 6 resides adjacent to the strap portion overlying the metacarpal-phalangeal joints of hand. Raised flexible bar 6 restricts torsional movement of the strap material and underlying skin covering the metacarpal-phalangeal joints during a golf club swing. When a golf club is gripped with the golf strap 1 of the present invention, raised flexible bar 6 facilitates 115 placement of the grip adjacent to the proximal phalanges of the golfer's hand, causing the club to be gripped by the fingers rather than with the palm of the hand to ensure a correct gripping position.

As shown in FIG. 8, the raised flexible bar 6 extends diagonally across the roots of the fingers from about the outer edge of the index finger 9 of the golf strap 1 substantially parallel to a transverse crease of the palm of the hand of the user. It is understood that due to individual variances in the transverse creases of the palm of the hand, including less than fully linear creases on the hand of some individuals, the tracking of the slope of the transverse creases is approximate. In general, however, the lines of the transverse creases indicate the correct position for the grip portion of a golf club. The raised flexible bar 6 is also positioned a distance above those portions covering the thenar 13 area of the hand. Since the conventional golf club shaft is tapered at the zone gripped by the upper hand, the raised flexible bar 6 may adjust slightly toward the line formed by the transverse creases to accommodate the taper.

The raised flexible bar 6 of the golf strap 1 extends from about the outer edge of the index finger 9 to about the outer edge of the pinky finger 12, spanning substantially the entire palm area 2. It should be understood that it is the relative length of the raised flexible bar 6 that is important to the invention. The relative length shown in this embodiment is sized to accommodate a variety of grips, even where a user employs a close grip such as interlocking first two fingers of the upper hand with the second two fingers of the lower hand.

To achieve the desired comfort and grip enhancement with the present invention, the golf strap 1 should preferably have a length of about 11 inches, a width of about 1.25 inches and a thickness of about 1/16 of an inch. The diameter of the raised flexible bar 6 may be varied with the size of the golf strap 1 and with the size of the golf club gripping portions of the clubs. In this preferred embodiment, the raised flexible bar 6 should be about 0.5 inches in diameter and generally semi cylindrical in shape, being of a thickness sufficient to support the golf club without lapping or creasing.

As shown in FIGS. 7 and 8, a gripping portion 14 of a golf club shaft 15 is being grasped by a wearer of the golf strap 1 with the palm 2 of the strap being initially cupped around the gripping portion 14 to abut the gripping portion 14 along the length of the raised flexible bar 6 as shown in FIG. 8.

Figure 10:
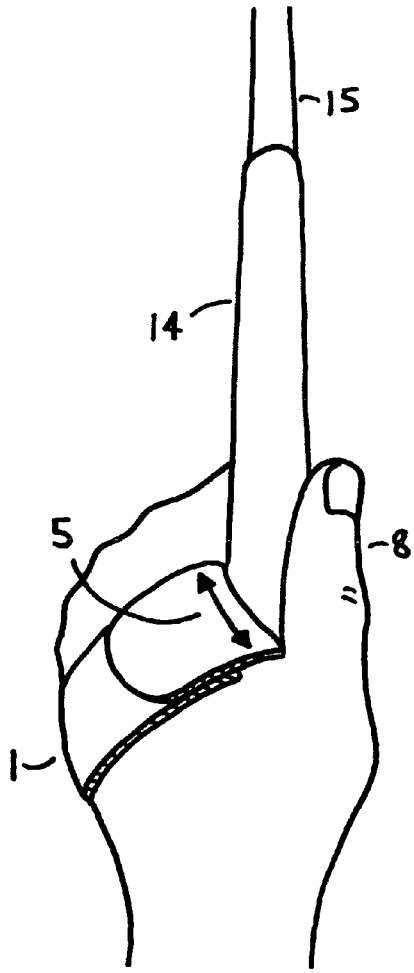
FIG. 10 is a perspective view showing the closed grip position of the golfer's left hand (right-handed golfer) closed around the grip portion of a golf club.

As shown in FIG. 10 the fingers are wrapped around the gripping portion 14, and the raised flexible bar 6 will automatically align the gripping portion 14 and the shaft 15 along a line substantially parallel to the transverse creases of the hand to ensure a proper grip. A conventional golf club shaft has a gripping zone for the left-hand that tapers from a diameter of about one-inch at the heel of the hand to a diameter of about seven-eighths of an inch at the thumb portion 8 of the hand. Thus the shaft decreases about one-eighth inch in diameter along the grip portion thereof that is spanned by the left-hand of the golfer. The raised flexible bar 6 to align the golf club shaft 15 in a line 16 (FIGS. 7 and 8) parallel to the transverse creases of the hand should then converge about one-eighth of an inch toward the line from its heel and to its thumb-end.

Once the strap 1 is placed on the hand, the player would select a club, excluding his. putter, and address the ball prior to striking the ball. The player then grips the golf club gripping portion 14 with his strapped hand. At this point the player could determine whether he has properly gripped the club by the feel of the alignment of the gripping portion 14 along the raised flexible bar 6. When the gripping portion 14 is aligned along the raised flexible bar 6 then the player is properly gripping the golf club.

FIG. 10 shows the closed grip position of the golfer's hand wearing the strap 1 about the grip portion 14 of a golf club. The raised flexible bar 6 automatically properly aligns the golfer's hand relative to the golf club shaft 15 and affords an abutment to maintain this alignment after the shaft is firmly gripped and remain in proper grip position during and after closure of the hand about the shaft and throughout the entire swing and follow-through.

While the invention has been described with references to certain preferred embodiments those skilled in the art will recognize that modifications and variations may be made in construction and material without departing from the spirit and scope of the present invention, which is intended to be limited only by the scope of the claims appended hereto.

I claim:

1. A method of adjusting a user's grip on a golf club, comprising:

providing an elongated strap having a first end, a second end, and a palm portion between the first and second ends, the palm portion comprising a hand-facing side and a club-facing side;

positioning the elongated strap so that the hand-facing side of the palm portion faces a palm of the user's hand and a raised flexible member extending diagonally across a width of the club-facing side of the palm portion faces away from the palm; and securing the first and second ends of the elongated strap to one another to attach the strap to the user's hand, wherein the act of positioning the elongated strap comprises positioning the elongated strap on an outside surface of a glove worn on the user's hand so that the elongated strap at least partially surrounds the glove.

2. The method of claim 1, wherein the act of positioning of the elongated strap comprises adjusting the position of the raised flexible member so that the raised flexible member is substantially parallel to a transverse crease of the user's hand.

3. The method of claim 1, wherein the act of positioning of the elongated strap comprises adjusting the position of the raised flexible member until a visual alignment indicator is aligned with an anatomical feature of the user's hand.

4. The method of claim 1, wherein the raised flexible member is sized to substantially span the entire palm of the user.

5. The method of claim 1, further comprising gripping a golf club so that at least a portion of the raised flexible member is in contact with a surface of a grip of the golf club, the golf club extending diagonally across the width of the club facing side of the palm portion in the same general direction as the raised flexible member.

6. The method of claim 1, wherein the act of securing the first and second ends of the elongated strap comprises attaching a first securing member on the first end of the strap to a second securing member on the second end of the strap.

* * * * *